United States Patent [19]

Neelman et al.

[11] Patent Number: 4,843,962

[45] Date of Patent: Jul. 4, 1989

[54] DOUBLE-FEED ENVELOPE GUIDE SYSTEM FOR PRINTING PRESS

[75] Inventors: Herbert H. Neelman, Boonton; Guy A. Scognamiglio, Jr., West Milford, both of N.J.

[73] Assignee: Seabar, Inc., West Milford, N.J.

[21] Appl. No.: 285,589

[22] Filed: Dec. 16, 1988

[51] Int. Cl.[4] ..... B41F 13/64

[52] U.S. Cl. ..... 101/240; 271/9; 271/233; 271/236

[58] Field of Search ..... 101/236–240, 101/2; 271/2, 9, 233, 236, 226; 400/604–605, 624, 625, 627

[56] References Cited

U.S. PATENT DOCUMENTS

| | | | |
|---|---|---|---|
| 3,146,902 | 9/1964 | Voelker | 271/2 |
| 3,212,774 | 10/1965 | Ingalls | 101/240 |
| 3,890,185 | 6/1975 | Umazume | 271/9 |
| 3,895,574 | 7/1975 | Nyborg | 101/240 |
| 4,181,078 | 1/1980 | Davis | 101/240 |
| 4,384,710 | 5/1983 | Gustafson | 271/9 |
| 4,662,765 | 5/1987 | Kapp et al. | 400/605 |

*Primary Examiner*—E. H. Eickholt

*Attorney, Agent, or Firm*—Martha G. Pugh

[57] ABSTRACT

This relates to an attachment kit for an offset printing press of the type manufactured and sold by A. B. Dick Company, which attachment comprises a leveling system including a pair of pivoting boards constructed to be mounted in parallel relation on a base board set on the feed table of the press to support two piles of envelopes in side-by-side relation. The vertical leg of a T-shaped guide bar having its cross bar and spacer fastened to the main bar of the press, passes between the two piles of envelopes and projects into a slot in the base board. A pair of backing plates having vertically-projecting members which bear against the rear of the envelope piles, are constructed to be fastened on opposite sides of the main bar of the printing press. This arrangement enables two piles of envelopes to pass through and be printed simultaneously by the press.

6 Claims, 6 Drawing Sheets

DOUBLE-FEED ENVELOPE GUIDE SYSTEM FOR PRINTING PRESS

BACKGROUND OF THE INVENTION

This relates in general to improvements in printing presses, and more particularly, to an attachment designed to provide a double-feed envelope guide system.

In printing establishments, it is important to provide flexibility for the equipment, which enables the equipment to handle either large or small quantities of materials of different sizes to be printed, with equal facility. Of special concern are devices for printing envelopes, such as the commonly used A. B. Dick Offset printing device, which should be adaptable to the printing of envelopes in different sizes, and different quantities. It is imperative that attachments for converting the offset printing press from single to double-feed status should have a minimal number of parts and should be of such a nature that they can be simply and easily installed and detached without making any significant changes in the basic machine.

A number of prior art devices have been developed which purport to perform the function of converting an offset printing press, such as the type manufactured and sold by the A. B. Dick Company, from single to double-feed status, so as to guide a pair of envelopes side-by-side through the machine simultaneously in perfect register. These devices have been found to be unsatisfactory for one or more of the following reasons:

(a) They require a large number of parts.

(b) They require modification of the primary press by drilling or machining for installation.

(c) They are time consuming to install and disconnect from the primary offset press.

(d) They include parts which require constant adjustment during the period of operation.

It is therefore the primary object of this invention to provide an improved attachment for guiding two envelopes side-by-side through an offset printing device.

A more particular object of the invention is to provide such an attachment for simultaneously guiding two envelopes through an offset printing device which is simpler and easier to install on an offset duplicating machine than prior art devices for performing a similar function.

Another object of the invention is to provide such a device which comprises a minimum number of parts.

Another object is to provide such a device which is readily installed without drilling or machining to modify the primary press.

Another object is to provide such a device which, after installation, operates successfully to perform its function without manual adjustment or intervention.

These and other objects, features and advantages are realized in an attachment of the present invention for converting a conventional A. B. Dick Offset duplicator to simultaneously guide two envelopes side-by-side through the machine in perfect registration, cutting the actual impressions and running time in half, and requiring no modification of the primary press.

SHORT DESCRIPTION OF THE INVENTION

The kit, in accordance with the present invention for attaching to a conventional A. B. Dick Offset Press, comprises a dual leveling mechanism which is constructed to be mounted on top of the existing paper feed table of the press. The leveling mechanism comprises a pair of rectangular pivoting boards which are mounted in side-by-side relation by pins journaled in brackets on a rectangular bottom board, so that they each freely rock to the left or right about their central long axes. The front of the bottom board is centrally slotted to accommodate the vertically-extending lower leg of a guide bar and spacer which terminates at its upper end in a T-shaped bar, one end of which is bent downwardly to form a hook-shaped projection. The other end of the T-bar fits into a rectangular central slot on the lower surface of a laterally-extending rectangular main bar of the press. The latter has two additional rectangular slots on its lower surface near its outer ends, which slideably accommodate the inner ends of a pair of flat backing plates. The backing plates having vertically-depending projecting members which contact and hold in place the forward ends of the dual piles of envelopes which are mounted on the leveling mechanism, the outer sides of the piles being held in place against the existing side guides of the offset press. Adjacent the slots on opposite ends of the main bar are forwardly-projecting U-shaped brackets which fit under and are tightened in place by laterally-extending set screws against the forward mounting bar of the press. A second pair of set screws with vertically-extending shanks serve to tighten the backing plates in place in their respective slots on the bottom of the main bar.

In putting the device in place for operation on a conventional A. B. Dick Offset Press, such as, for example, the Model 360CD, the set screws are tightened to hold the main bar in place on the mounting bar of the offset press. The vertical shank of the main guide bar of the attachment is then interposed through the forward slot in the bottom board of the leveling mechanism, and through a matching slot in the press paper feed table of the existing press on which it is mounted. The two piles of envelopes to be printed are placed on the two pivoting boards of the leveling mechanism, separated by the main guide bar, and held in place laterally by the existing side guides of the press. The two backing plates are then interposed into their respective slots in the main bar, and slid into place, and the set screws tightened, so that the depending shanks contact the ends of each of the piles of envelopes. As the envelopes move up, the two piles are kept separated by the downwardly-pointed envelope spacer at the inner end of the guide bar and spacer.

After the the double master has been properly set in place on the master roller, the machine is operated, without manual intervention or adjustment, to simultaneously imprint the two stacks of envelopes.

Although for the purposes of illustration, the attachment of the present invention is described with reference to A. B. Dick Offset Printer, Model 360CD, it will be understood that the device can equally well be applied to other A. B. Dick Models, such as 350CD and 375CD and subsequent models. The A. B. Dick Offset duplicators with which the subject device is designed for use, are described in detail in a brochure published by the A. B. Dick Company, Chicago, Ill., ©1979 A. B. Dick Company, which is incorporated herein by reference.

Particular features of this invention over other types of attachments for offset duplicating machines designed to provide double-feed guide systems are that:

(a) it requires no drilling, or other alteration or modification, of the primary duplicating machine for installation of the attachment;
(b) the attachment is simple to install, and comprises a minimal number of parts;
(c) the attachment requires no manual adjustment during operation.

Other objects, features and advantages of the invention will be apparent upon a study of the detailed description of the invention with reference to the attached drawings.

SHORT DESCRIPTION OF THE DRAWINGS

FIG. 1 is a front perspective showing of the double-feed envelope guide system comprising the attachment kit of the present invention installed in an A. B. Dick Offset Press.

FIG. 2 shows, in perspective, the elements of the attachment kit of the present invention for converting an A. B. Dick Offset Press into a double-feed envelope guide system, which elements have been removed from the offset press.

DETAILED DESCRIPTION OF THE INVENTION

Although it is contemplated that the general principles of this invention can be applied to double-feed guide systems for envelopes as used on other offset duplicating machines, the specific example disclosed herein has been constructed for attachment to the A. B. Dick Model 360CD. The latter is described in detail in a brochure published by the A. D. Dick Company, 5700 West Touhy Average, Chicago, Ill. 60648, Pat. 7806-1, ©Copyright 1979 A. B. Dick Company, which is incorporated herein by reference. In addition to Model 360CD, it is contemplated that the double-feed envelope guide system, as disclosed and claimed herein, can be adapted for use with other A. B. Dick models of duplicating machines, such as the 350CD and 375CD.

Figure 1:
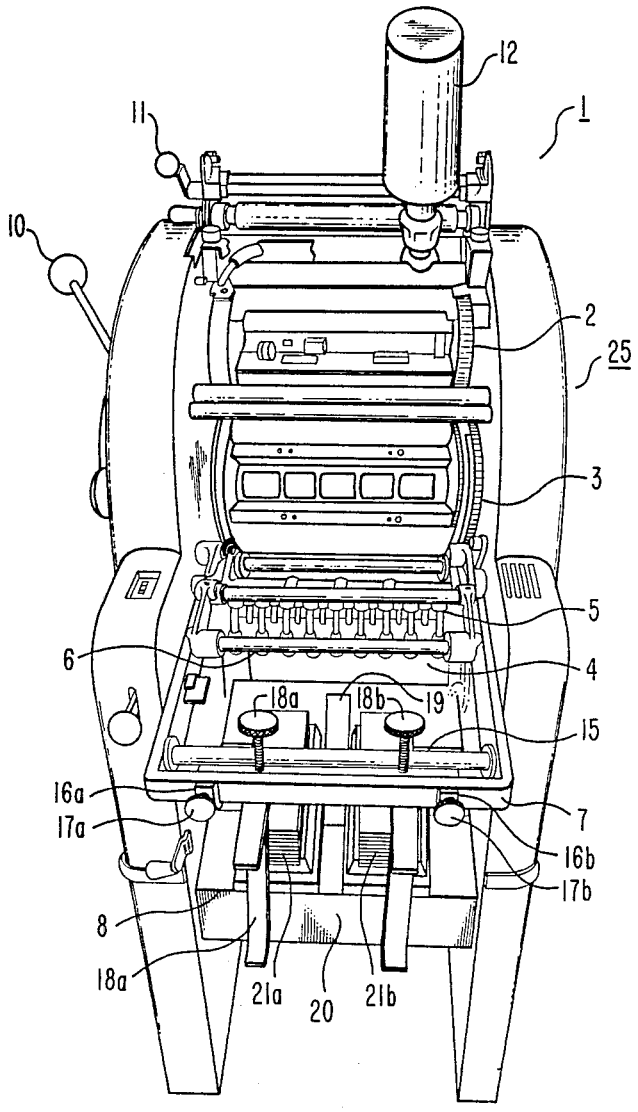

Referring to FIG. 1 of the drawings, there is shown the attachment of the present invention mounted on an A. B. Dick Model 360CD offset duplicating device, for converting the same into a double-feed envelope guide system designed to print two piles of envelopes simultaneously in perfect registration.

The offset duplicating machine 1 comprises three primary cylinders, a master cylinder 2, a blanket cylinder 3, and an impression cylinder 4 which are mounted on parallel axes in a housing 26 to rotate in respectively contiguous relation. A system of twelve smaller rollers function to bring ink from the ink fountain under control of a lever, not shown, and water from the water fountain 12 under control of lever 11, and to apply the same to the master cylinder 2, to which a master plate or sheet has been fixed on which is etched or embossed the legend to be printed. The impression is then transferred in offset relation to the blanket cylinder 3, from which the legend is simultaneously imprinted on a pair of envelopes passing between the blanket cylinder 3 and impression cylinder 4 which are constantly rotated towards one another during operation of the machine.

The offset printer has a paper feed table 8 comprising a rectangular support which is driven by a motor and system of gears under control of the feed table speed control 9 to move up or down vertically in the housing 25. When the operation control lever 10 is implemented to operate the printing press, this places the piles of paper stock in position to be moved forward and picked up piece by piece for passage between the blanket cylinder 3 and impression cylinder 4 during the printing process under control of the paper height regulators 5 and the suction contact and paper guide assembly 6.

The mounting bar 7 comprises a pair of lateral arms, $14\frac{1}{2}$ inches long, 1 inch wide and $\frac{3}{8}$ inch thick, the inner ends of which are connected to the inner surface of the housing 25 adjacent opposite ends of the suction contact and paper guide assembly 6. The outer ends of the mounting bar 7 are connected together by a bar $6\frac{1}{2}$ inches long, $1\frac{1}{2}$ inches wide and $\frac{1}{8}$ inch thick, thereby forming an open three-quarter rectangular frame disposed to surround a plane parallel to the upper surface of the paper feed table 8.

The double-feed envelope guide system of the present invention as shown in FIG. 1 comprises an elongated main bar 15 attached to the mounting bar 7. A pair of backing plates each comprising a horizontal member **18*a*, 18*b*, and a depending vertical member 18*c*, 18*d* are slideably accommodated in slots near opposite ends of mounting bar 7**.

Centrally connected to the main bar 15 of the attachment of the present invention is a T-shaped guide bar and spacer 19 which has an inwardly projecting top member **19*a* which terminates at its inner end in a downwardly projecting hook 19*c*. (See FIG. 2). The shank 19*b* of guide bar 19 projects downwardly vertically and is accommodated in a central rear slot in leveling mechanism 20 of the combination of the present invention, which is mounted on the upper surface of the paper feed table 8**.

The leveling mechanism 20 comprises a pair of rectangular boards **20*a* and 20*b* which are pivotally mounted in parallel symmetrical relation on a rectangular base board 20*c*. (See FIGS. 3, 4, and 5). Two identical pairs of envelopes 21*a* and 21*b* are mounted on the pivot boards 20*a* and 20*b* for simultaneous processing in the offset duplicator 1**.

The foregoing elements will be described in detail with reference to FIGS. 2–10 hereinafter.

Figure 2:
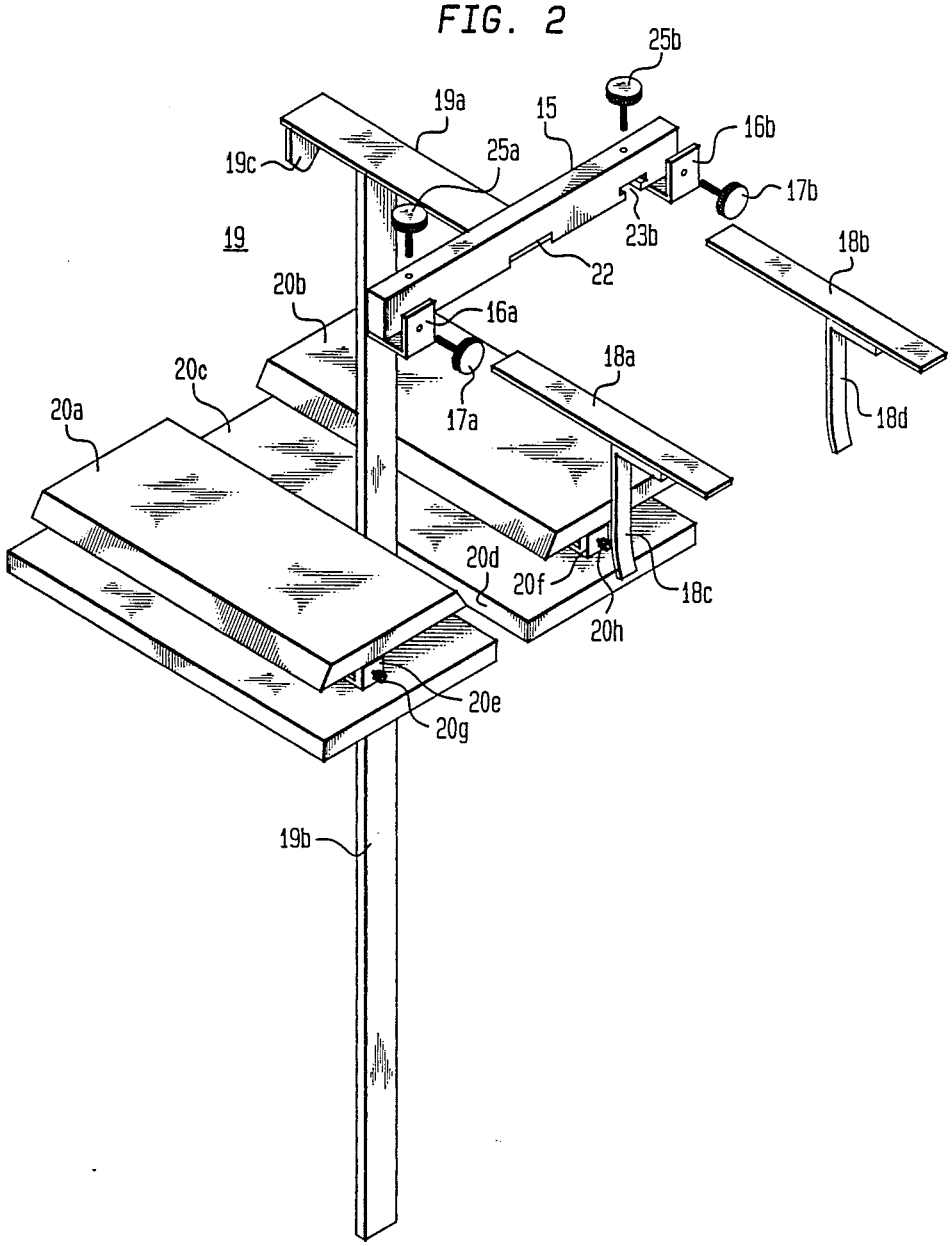

FIG. 2 shows the assembled attachment elements of the present invention removed from the duplicating device 1.

Figures 6, 7:
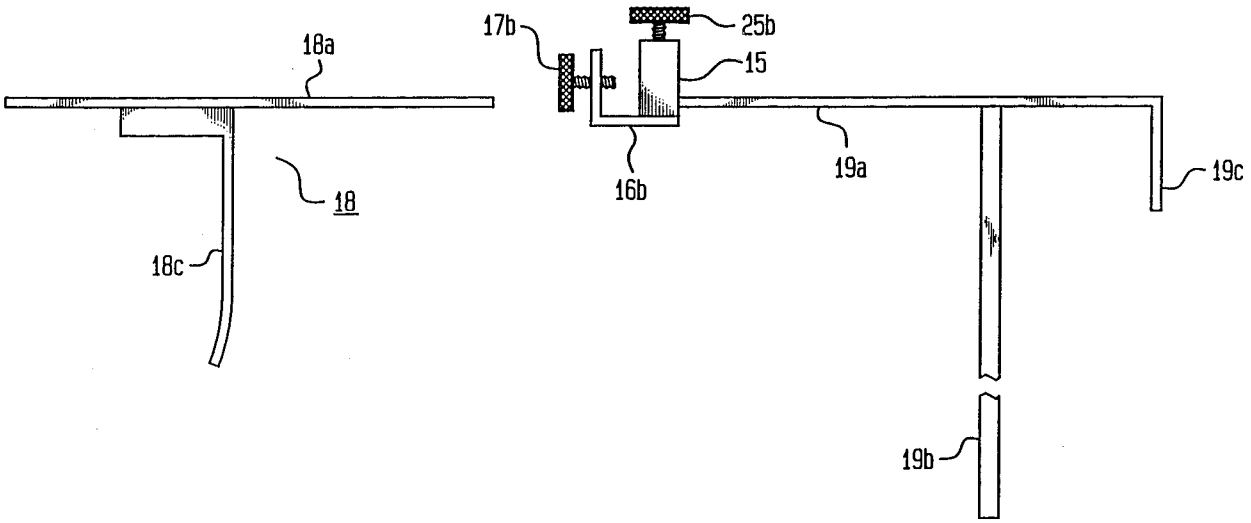
FIG. 6 is a showing, in side-elevation, of one of the backing plates of FIG. 2, the other backing plate being substantially identical.
FIG. 7 is a view, in side-elevation, of one side of the guide bar and bracket of FIG. 2, the view from the opposite side being substantially a mirror image thereof.
Figure 8:
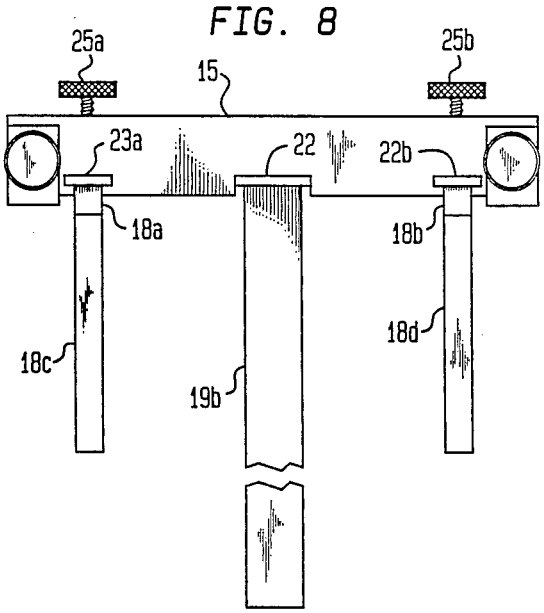
FIG. 8 is a front-elevational view of the guide bar and bracket assemblage of FIG. 2.
Figure 9:
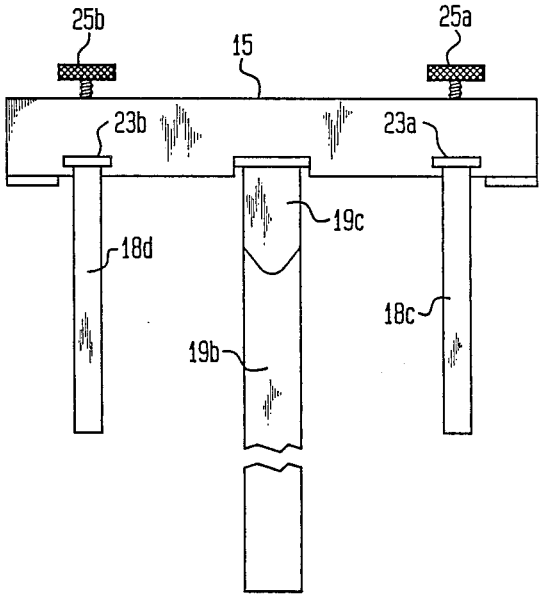
FIG. 9 is a rear-elevational view of the guide bar and bracket assemblage of FIG. 2.

The main bar 15, which is also shown in side-elevation in FIG. 7, is substantially a parallelpiped 7 inches long, having a rectangular section $\frac{1}{3}$–8 inches by $\frac{3}{8}$ inch to the inside lateral surface of which, adjacent the two ends, are attached a pair of hook-shaped brackets 16*a*, 16*b*. These are each $\frac{1}{2}$ inch wide, extending out $\frac{7}{8}$ inch from the external lateral wall of main bar 15, and terminating in each case in a vertical flange which projects up 1 inch. This provides in each bracket a slot $\frac{3}{8}$ inch wide and $\frac{7}{8}$ inch high, which just accommodates the mounting bar 7 which rests therein behind the main bar 15. The center of each of the brackets is drilled with a screw hole to accommodate the screw-threaded tightening screws 17*a*, 17*b* which are tightened to secure the main bar 15 of the attachments of the present invention in place in flush relationship against mounting bar 7 of the offset duplicator 1.

The main bar 15 has, on its lower surface three rectangular slots, two of which 23*a* and 23*b* are each 1 inch long, and 3/16 inch wide and $\frac{3}{8}$ inch deep, and are centered $1\frac{1}{4}$ inches in from the end, in each case. The slots 23*a* and 23*b*, respectively accommodate, in slideable relation, the horizontal arms 18*a*, 18*b*, of the backing plates 18. The latter, which are also shown in side-elevation in FIG. 6, comprise horizontally-disposed plates 18*a* and 18*b*, which are each $6\frac{1}{4}$ inches long, 15/16 inch wide, and $\frac{1}{8}$ inch thick, to the bottom surfaces of each of which are respectively connected the vertical legs 18*c* and 18*d*. The latter comprise L-shaped members attached by a short horizontal flange $\frac{1}{4}$ inch from each of their outer ends, and each having a vertically-depending leg $2\frac{3}{4}$ inches long, and $\frac{1}{2}$ inch wide and $\frac{1}{8}$ inch thick. The plates 18*a* and 18*b* are respectively slideably accommodated in the slots 23*a* and 23*b* in the main bar 15, where they are slid into position so that the vertical legs 18*c*, 18*d* contact the back edges of two parallel piles 21*a*, 21*b* of envelopes to be simultaneously printed.

Centered over each of the slots 23*a* and 23*b* is a screw hole which accommodates a respective one of set screws 25*a*, 25*b*, the vertical shanks of which penetrate the screw holes to contact and hole the back plates 18*a* and 18*b* in a desired position.

The third rectangular slot 22 which is across the center on the bottom surface of main bar 15, is $\frac{1}{2}$ inch wide, 1 inch long, and $\frac{3}{8}$ inch deep. This accommodates, in flush relation, the outer end of the rectangular top plates 19*a* of the guide bar and spacer 19, which is shown in perspective as part of the assemblage of FIG. 2, and in side-elevation in FIG. 7. T-shaped guide bar and spacer 19 comprises rectangular top plate 19*a*, which is $6\frac{5}{8}$ inches long, 1 inch wide, and $\frac{1}{8}$ inch thick, terminating at its inner end in a downwardly-depending hook-shaped projection 19*c*, $\frac{3}{4}$ inch wide, which projects $1\frac{1}{2}$ inches down along its vertical edges, and is tapered to a point $\frac{1}{4}$ inch below the center, which projects between and separates the two piles of envelopes 21*a*, and 21*b*. Guide bar and spacer assemblage 19, in addition to being shown in perspective in the assemblage of FIG. 2, is shown in side-elevation in FIG. 7, and is shown in front and rear-elevation in FIGS. 8 and 9.

Welded or otherwise secured $2\frac{1}{2}$ inches in from the outer end of the bar 19*a* is the rectangular vertically-depending leg 19*b* which is 22 inches long, $\frac{3}{4}$ inch wise, and $\frac{3}{8}$ inch thick, and which is accommodated in a slot in leveling mechanism 20, as will be described.

Figure 3:
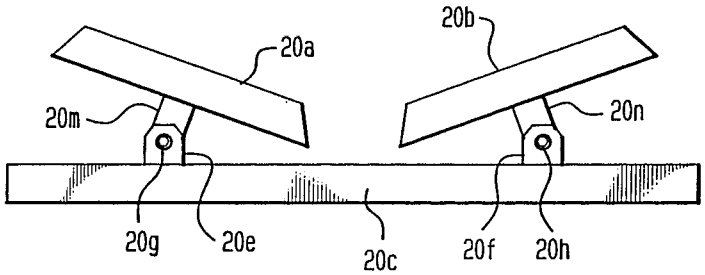
FIG. 3 is a showing, in end-elevation, of the dual pivoting boards comprising the leveling mechanism of the present invention, which are shown in angled relationship towards each other.
Figure 4:
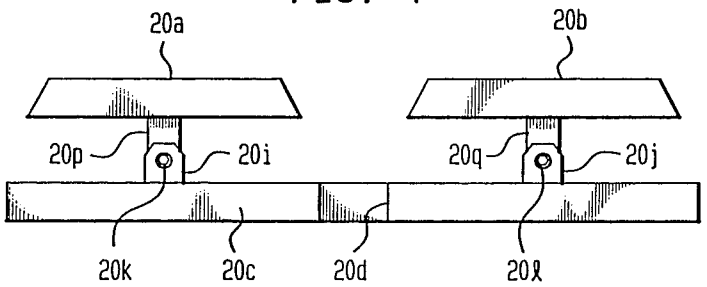
FIG. 4 is a showing, in end-elevation of the dual pivoting boards of FIG. 3 disposed in coplanar relationship.
Figure 5:
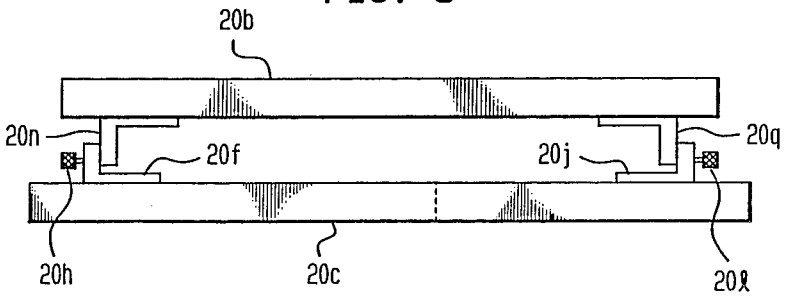
FIG. 5 is a side-elevational showing of one side of the dual pivoting boards of FIG. 4, the other side being substantially a mirror image thereof.

The leveling mechanism 20, which is shown in perspective as part of the assemblage in FIG. 2, and is shown in end-elevation, and in side-elevation in FIGS. 3, 4 and 5, comprises a rectangular base board 20*a*, which is $9\frac{1}{4}$ inches long, 9 inches wide, and $\frac{1}{2}$ inch thick. Centered on the inside rear edge of the base board 20*a* is a slot 20*d*, 4 inches long and $\frac{7}{8}$ inch wide, which accommodate the leg 19*b*, of the guide bar and spacer 19, which, when the leg is in place, extends into a matching slot already existing in the paper feed table of the A. B. Dick Offset Press 1.

Each of the pivoting boards 20*a* and 20*b*, which are $9\frac{1}{4}$ inches long, and $3\frac{3}{4}$ inches wide, and $\frac{1}{2}$ inch thick, is mounted along its central long axis between a pair of pivot brackets 20*e* and 20*i* on one end and 20*f* and 20*j* on the other, which are coupled to depending centered downwardly-projecting pivot flanges 20*m*, 20*p* on the ends of 20*a*; and 20*n* and 20*q* on the ends of 20*b* by pivot pins 20*g*, 20*k* and 20*h*, 20*l* respectively. The pivots are centered on the central long axes of 20*a* and 20*b* along lines parallel to and $1\frac{3}{4}$ inches from the parallel opposite edges of base board 20*c*. With this arrangement the pivot boards 20*a* and 20*b* are positioned to tip either towards the center or towards the edges of base board 20*c*, as required to maintain the piles 21*a* and 21*b* level at the top, in contact with the tops 18*a*, 18*b* of the backing plates 18.

Figure 10:
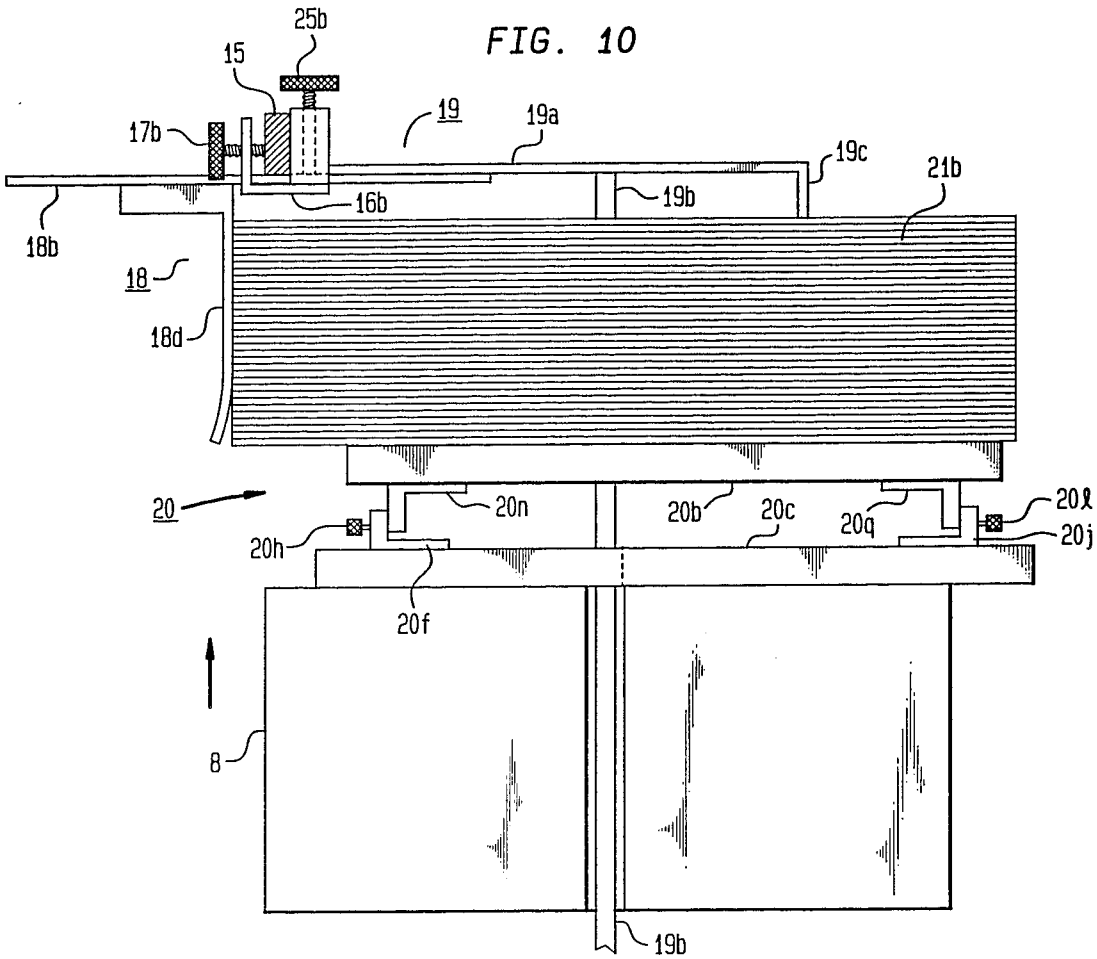
FIG. 10 is a side-elevational showing of the press, including the attachment of the present invention, in side-elevation, viewing one of the two identical piles of envelopes being serviced.

FIG. 10 shows, in side-elevation, one pile 21*a* of the two identical piles of envelopes mounted on the leveling device 20, with the guide bar and spacer assemblage 19 in place, and the backing plates in place for simultaneously printing two piles of envelopes on an A. B. Dick Offset duplicating machine.

It will be understood that the invention is not limited to the specific type of offset duplicating machine disclosed herein by way of illustration, or the specific form, structure or dimensions of the attachments of the present invention therefor, for providing a double-feed guide system for envelopes, which are disclosed by way of illustration, but only by the scope of the appended claims.

What we claim is:

1. An attachment kit for providing a double-feed guide system for envelopes when mounted in combination with an offset printing press having a paper feed table comprising a plane top surface adjustable to different horizontal levels and a rectangular mounting bar enclosing a plane substantially parallel to said plane top surface adjacent the level of paper feed into said press, which comprises in combination:

a leveling mechanism constructed to be mounted on the plane top surface of said paper feed press, said leveling mechanism comprising a base plate and a pair of pivoting boards mounted in substantially symmetrical relationship on said base plate, and constructed to pivot freely in either lateral direction on said base plate in response to differences in pressure due to the weight of envelopes piled on said pivoting boards, at different points across the width thereof;

a laterally-extending main bar including bracket means for securing said main bar to the mounting bar of said offset press;

a substantially T-shaped guide bar and spacer combination, comprising a top bar which is connectable in a substantially normal inwardly-projecting direction in a substantially horizontal plane to central connecting means on said main bar, said top bar including a spacer at the inner end of said top bar comprising a downwardly-projecting pointer constructed to be interposed between and separate said envelope piles;

said guide bar including an elongated downwardly-depending shank secured to said top bar between its inner and outer ends; and a slot centered on the inner side of the base board of said leveling device for accommodating said shank.

2. An attachment kit in accordance with claim 1 which includes a pair of backing plates each comprising a rectangular top plate, and a vertically-extending leg constructed to contact the outer ends of said envelope piles, and wherein said main bar includes at its opposite ends connecting means for accommodating each of said top plates in slideable relation.

3. An attachment in accordance with claim 2 wherein said connecting means on said main bar comprise on its bottom surface a central slot and a pair of lateral slots on opposite ends thereof for respectively accommodating one end of said top bar in said central slot and said rectangular top plates in said lateral slots.

4. An offset printing press having a paper feed table comprising a plane top surface adjustable to different horizontal levels and a rectangular mounting bar enclosing a plane parallel to the top surface of said feed table adjacent the level of paper feed into said press, which comprises in combination with said offset press system an attachment providing a double-feed guide system for envelopes, said attachment comprising:

a leveling mechanism constructed to be mounted on the plane top surface of said paper feed press, said leveling mechanism comprising a base plate and a pair of pivoting boards mounted in substantially symmetrical relationship on said base plate, and constructed to pivot freely in either lateral direction on said base plate in response to differences in pressure due to the weight of envelopes piled on said pivoting boards, at different points across the width thereof;

a laterally-extending main bar including bracket means for securing said main bar to the mounting bar of said offset press, said main bar having a plurality of connecting slots;

a substantially T-shaped guide bar and spacer combination, comprising a top bar which is connectable in a substantially normal inwardly-projecting direction from one end in a substantially horizontal plane to central connecting means on said main bar, said top bar including a spacer at the other end of said top bar comprising a downwardly-projecting pointer constructed to be interposed between and separate said envelope piles;

said guide bar including an elongated downwardly depending shank secured to said top bar between its inner and outer ends; and a slot centered on the inner side of the base board of said leveling device for accommodating said shank.

5. An offset printing press in accordance with claim 4, wherein said attachment includes a pair of backing plates each comprises a rectangular top plate, and a vertically-extending leg constructed to contact the outer ends of said envelope piles, and wherein said main bar includes at its opposite ends connecting means for accommocating each of said top plates in slideable relation.

6. An offset printing press in accordance with claim 4 wherein the connecting means on said main bar comprise on its bottom surface a central slot and a pair of lateral slots on opposite ends thereof for respectively accommodating said one end of said top bar in said central slot and said rectangular top plates in said lateral slots.

* * * * *